US007852272B2

(12) United States Patent
Imano et al.

(10) Patent No.: US 7,852,272 B2
(45) Date of Patent: Dec. 14, 2010

(54) WIRELESS UNIT ANTENNA APPARATUS AND MOBILE WIRELESS UNIT

(75) Inventors: Daigo Imano, Miyagi (JP); Hironori Kikuchi, Miyagi (JP)

(73) Assignee: Panasonic Corporation, Osaka (JP)

( * ) Notice: Subject to any disclaimer, the term of this patent is extended or adjusted under 35 U.S.C. 154(b) by 304 days.

(21) Appl. No.: 12/066,049

(22) PCT Filed: Sep. 6, 2006

(86) PCT No.: PCT/JP2006/317655

§ 371 (c)(1),
(2), (4) Date: Mar. 6, 2008

(87) PCT Pub. No.: WO2007/029741

PCT Pub. Date: Mar. 15, 2007

(65) Prior Publication Data

US 2009/0102726 A1 Apr. 23, 2009

(30) Foreign Application Priority Data

Sep. 9, 2005 (JP) ..... 2005-262259

(51) Int. Cl.
*H01Q 1/24* (2006.01)

(52) U.S. Cl. ..... 343/702; 343/724; 343/725; 343/726; 343/853; 343/860

(58) Field of Classification Search ..... None
See application file for complete search history.

(56) References Cited

U.S. PATENT DOCUMENTS 6,295,030 B1 * 9/2001 Kozakai et al. ..... 343/700 MS
6,310,578 B1 * 10/2001 Ying ..... 343/702
6,380,903 B1 * 4/2002 Hayes et al. ..... 343/725
7,084,831 B2 * 8/2006 Takagi et al. ..... 343/860
7,102,587 B2 * 9/2006 Benton et al. ..... 343/873
2002/0021253 A1 * 2/2002 Muramoto et al. ..... 343/702

FOREIGN PATENT DOCUMENTS

EP 1 562 259 A1 * 8/2005
JP 2005-223686 A * 8/2005

* cited by examiner

*Primary Examiner*—Trinh V Dinh
(74) *Attorney, Agent, or Firm*—Pearne & Gordon LLP

(57) ABSTRACT

The present invention provides an antenna apparatus for a wireless unit, the antenna apparatus exhibiting a reduced specific absorption rate (SAR) without an additional component for reducing the SAR, which is the amount of energy of an electromagnetic wave absorbed by a human body. The antenna apparatus comprises a board 114 serving as a ground plate of an antenna, a first antenna element 102 transmitting and receiving an electromagnetic wave in a first frequency band and provided on the board 114 through the first feeder 107, and a second antenna element 110 transmitting and receiving an electromagnetic wave in a second frequency band and provided on the board 114 through the first feeder 111, wherein the total of an electrical length between the first and second feeders 107 and 111, an electrical length of the first antenna element 102, and an electrical length of the second antenna element 110 is larger than a half wavelength of the first frequency band and equal to or smaller than one wavelength of the first frequency band.

11 Claims, 12 Drawing Sheets

---- HIGH FREQUENCY CURRENT

TOTAL OF ELECTRICAL LENGTH OF FIRST ANTENNA ELEMENT 102, ELECTRICAL LENGTH OF SECOND ANTENNA ELEMENT 110, AND ELECTRICAL LENGTH BETWEEN FIRST FEEDER 107 AND SECOND FEEDER 111

WIRELESS UNIT ANTENNA APPARATUS AND MOBILE WIRELESS UNIT

CROSS REFERENCE TO RELATED APPLICATIONS

The present application is a 371 of PCT/JP2006/317655 filed Sep. 6, 2006, claims priority under Title 35, United States Code 119(a-d) of Japan 2005-262259 filed Sep. 9, 2005.

TECHNICAL FIELD OF THE INVENTION

The present invention relates to an antenna apparatus for a wireless unit and a mobile wireless unit.

BACKGROUND OF THE INVENTION

In relation to the conventional wireless units of this type, there have been reported adverse effects on a human body due to exposure of the human body to a high-intensity electromagnetic wave in recent years. The reported adverse effects include an elevation of the temperature of the human body, and stimulation of a nerve in the human body. In consideration of the adverse effects on the human body, a regulation has been established since June, 2002 to ensure that a specific absorption rate (SAR) must be 2 mW/g or less. The SAR is the amount of energy of an electromagnetic wave transmitted by a wireless unit, such as a mobile phone, during a phone call and absorbed by a specific part (especially, a head) of a human body for six minutes, and is measured as an average over a 10-gram cube of a human tissue.

The SAR is expressed as $\sigma E2/\rho$, where $\sigma$ is a conductivity (Siemens/meter) of a human tissue, E is a field intensity (Voltage/meter) of an electric field applied to the human body, and $\rho$ is an intensity ($kg/m^3$) of the human tissue. The SAR can be reduced by a reduction in the field intensity of the electric field, which varies depending on radiation power emitted from a wireless unit. When the radiation power emitted from the wireless unit is reduced, the SAR is also reduced. The reduction in the SAR, however, may result in a deterioration of the quality of communications performed by the wireless unit.

In order to reduce the SAR without a reduction in the radiation power emitted from the wireless unit, there has been proposed a technique in which a conductive plate having a predetermined shape and a circuit board are short-circuited by a conductive material (refer to Patent Document 1).

FIG. 22 is a diagram showing the construction of a conventional antenna apparatus mounted in a mobile wireless unit including: a case 901; an antenna element 902 provided outside the case 901; a feeder 903 mounted in the case 901 and feeding an antenna; a circuit board 904; a shield case 905 for covering the circuit board 904; a conductive plate 906; a short-circuit conductor 907 for short-circuiting an end of conductive plate 906 with the shield case 905.

The conductive plate 906 and the other end of the shield case 905 are in an electrically open state. The conductive plate 906 has an electrical length, which is one-fourth wavelength of a frequency. This leads to the fact that impedance between the conductive plate 906 and the shield case 905 is about zero at an end portion of the conductive plate 906, which is short circuited with the shield case 905, and is almost infinite at another end portion of the conductive plate 906, which is in the electrically open state. The construction of the conventional antenna apparatus makes it difficult to cause a high frequency current to flow from the vicinity of the feeder 903 to the conductive plate 906 and the shield case 905. This results in a reduction in the amount of radiation of an electromagnetic wave from the conductive plate 906 and the shield case 905 and in a reduction in the SAR.

Patent Document 1: Japanese Patent Laid-Open Publication No. 2002-94311

DISCLOSURE OF THE INVENTION

Problems to be Resolved by the Invention

Each of the mobile wireless units used in recent years includes a wireless communication system used for audio and data communications, such as Personal Digital Cellular (PDC) and Wideband Code Division Multiple Access (W-CDMA), and a communication system for applications such as television, radio and short-range wireless communications. The size of each of the mobile wireless units tends to be increased. If the method disclosed in Patent Document 1 is used to reduce the SAR, the mobile wireless unit cannot be downsized, and the distance between front and back surfaces of the mobile wireless unit cannot be reduced. In this case, a component for reducing the SAR needs to be added, resulting in an increase in the cost of each of the mobile wireless units.

Means for Solving the Problems

It is, therefore, an object of the present invention to provide an antenna apparatus for a wireless unit, and a mobile wireless unit, each of which exhibits a reduced SAR without an additional component for reducing the SAR, and which can be downsized and constructed so as to reduce the distance between front and back surfaces of the mobile wireless unit.

The antenna apparatus for a wireless unit, according to the present invention, is designed to transmit and receive an electromagnetic wave in each of multiple frequency bands. The antenna apparatus comprises: a ground plate; a first antenna element for transmitting and receiving an electromagnetic wave in a first frequency band; a first feeder provided on the ground plate and feeding the first antenna element; a second antenna element for transmitting and receiving an electromagnetic wave in a second frequency band; and a second feeder provided separately from the first feeder on the ground plate and feeding the second antenna element, wherein the first antenna element is designed to extend from the first feeder to the outside of the ground plate, the second antenna element is designed to extend from the second feeder, and the total of an electrical length of the first antenna element, an electrical length of the second antenna element, and an electrical length between the first and second feeders is larger than a half wavelength of the first frequency band and is equal to or smaller than one wavelength of the first frequency band.

The antenna apparatus thus constructed according to the present invention is capable of distributing peak points of a high frequency current, which flows in the antenna elements and the ground plate and causes radiation of an electromagnetic wave from the antenna elements and the ground plate, to reduce the SAR without an additional component for reducing the SAR.

In the antenna apparatus for a wireless unit according to the present invention, the second antenna element and the first antenna element are in spaced relationship with each other, and substantially the same in direction as each other.

The antenna apparatus thus constructed according to the present invention is capable of distributing peak points of a high frequency current flowing from the antenna elements through the ground plate to the entire wireless unit to reduce the SAR without an additional component for reducing the SAR.

In the antenna apparatus for a wireless unit according to the present invention, the first and second antennas are substantially in parallel relationship to each other or are substantially in spaced relationship with each other.

The antenna apparatus thus constructed according to the present invention is capable of distributing peak points of a high frequency current flowing from the antenna elements through the ground plate to the entire wireless unit to reduce the SAR without an additional component for reducing the SAR.

In the antenna apparatus for a wireless unit according to the present invention, the second antenna element extends from a point located in symmetrical relationship to a point from which the first antenna element extends with respect to the center of the ground plate.

The antenna apparatus thus constructed according to the present invention is capable of distributing peak points of a high frequency current flowing from the antenna elements through the ground plate to the entire wireless unit to reduce the SAR without an additional component for reducing the SAR.

In the antenna apparatus for a wireless unit according to the present invention, the first and second feeders are located in symmetrical relationship to each other with respect to the center of the ground plate.

The antenna apparatus thus constructed according to the present invention is capable of distributing peak points of a high frequency current, which flows through the ground plate to the entire wireless unit and causes radiation of an electromagnetic wave from the antenna elements and the ground plate, to reduce the SAR without an additional component for reducing the SAR.

In the antenna apparatus for a wireless unit according to the present invention, the first and second antenna elements are substantially in perpendicular relationship with each other.

The antenna apparatus thus constructed according to the present invention is capable of reducing the degree of coupling between the first and second antenna elements and distributing peak points of a high frequency current flowing from the antenna elements through the ground plate to the entire wireless unit to reduce the SAR without an additional component for reducing the SAR.

In the antenna apparatus for a wireless unit according to the present invention, the second antenna element has the shape of straight line.

The antenna apparatus thus constructed according to the present invention is capable of distributing peak points of a high frequency current flowing from the antenna elements through the ground plate to the entire wireless unit to reduce the SAR without an additional component for reducing the SAR.

In the antenna apparatus for a wireless unit according to the present invention, the second antenna element has the shape of inverted-F.

The antenna apparatus thus constructed according to the present invention is capable of distributing peak points of a high frequency current flowing from the antenna elements through the ground plate to the entire wireless unit to reduce the SAR without an additional component for reducing the SAR.

The antenna apparatus for a wireless unit according to the present invention has a matching circuit for matching the second antenna element with a desired frequency band.

The antenna apparatus thus constructed allows the second antenna element to transmit and receive an electromagnetic wave in the desired frequency band, and is capable of reducing the SAR in the frequency band of the first antenna element.

In the antenna apparatus for a wireless unit according to the present invention, the first feeder is arranged on an end portion of the ground plate, and the second feeder is arranged on another end portion of the ground plate.

The antenna apparatus thus constructed according to the present invention has a reduced degree of the coupling between the first and second antenna elements and is capable of distributing peak points of a high frequency current, which flows through the ground plate to the entire wireless unit and causes radiation of an electromagnetic wave from the antenna elements and the ground plate, to reduce the SAR without an additional component for reducing the SAR.

The mobile wireless unit according to the present invention includes any one of the antenna apparatuses described above.

The mobile wireless unit thus constructed according to the present invention is capable of distributing peak points of a high frequency current, which flows through the ground plate to the entire wireless unit and causes radiation of an electromagnetic wave from the antenna elements and the ground plate, to reduce the SAR without an additional component for reducing the SAR.

The antenna apparatus for a wireless unit and the mobile wireless unit according to the present invention is capable of reducing the SAR in the frequency band of the first antenna element.

Figure 1A:
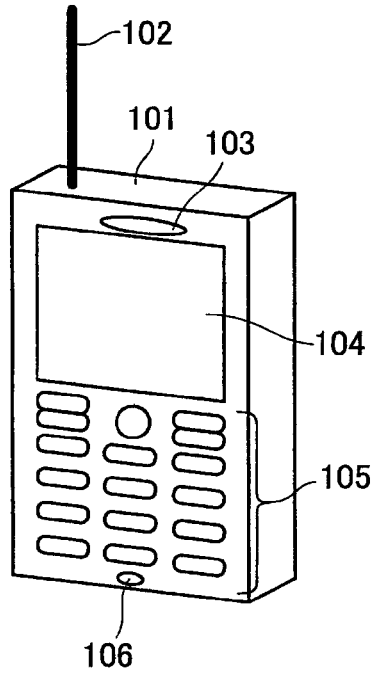
FIGS. 1(*a*) and 1(*b*) are diagrams each showing the construction of a mobile wireless unit mounting an antenna apparatus for a wireless unit according to the first embodiment of the present invention.

| Description of Reference Numerals | |
|---|---|
| 101, 201, 301, 401, 501, 601, 901: | Case |
| 102, 202, 302, 402, 502, 602: | First antenna element |
| 103, 203, 303, 403, 503, 603: | Receiver |
| 104, 204, 304, 404, 504, 604: | Display section |
| 105, 205, 305, 405, 505, 605: | Input section |
| 106, 206, 306, 406, 506, 606: | Transmitter |
| 107, 207, 307, 407, 507, 607: | First feeder |
| 108, 208, 308, 408, 508, 608: | First matching circuit |
| 109, 209, 309, 409, 509, 609: | First wireless communication circuit section |
| 110, 210, 310, 410, 510, 610: | Second antenna element |
| 111, 211, 311, 411, 511, 611: | Second feeder |

-continued

| Description of Reference Numerals | |
|---|---|
| 112, 212, 312, 412, 512, 612: | Second matching circuit |
| 113, 213, 313, 413, 513, 613: | Second wireless communication circuit section |
| 114, 214, 314, 414, 514, 614: | Board |

BEST MODE FOR CARRYING OUT THE INVENTION

The embodiments of the present invention will be described with reference to the accompanying drawings.

First Embodiment

Figure 1B:
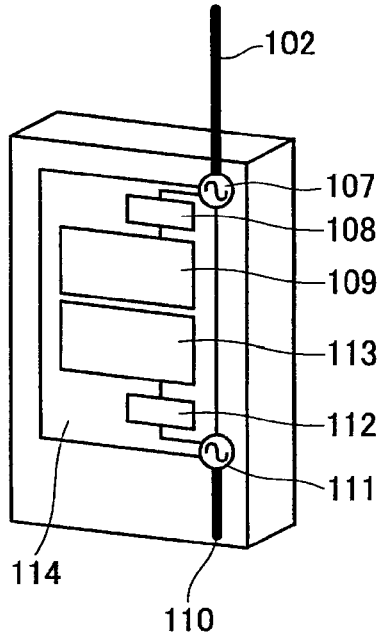
Figure 2A:
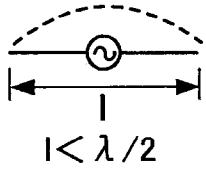
FIGS. 2(*a*) to 2(*d*) are diagrams each showing a distribution of a high frequency current flowing in an antenna element.
Figure 2B:
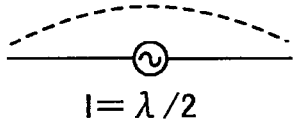
Figure 2C:
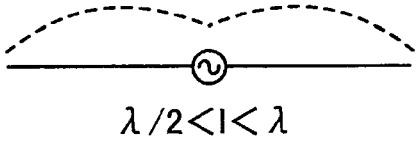
Figure 2D:
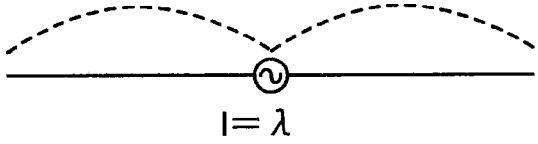

FIGS. 1(*a*) and 1(*b*) are diagrams each showing an outline construction of a mobile wireless unit according to the first embodiment of the present invention. FIG. 1(*a*) is a front view of the mobile wireless unit, and FIG. 1(*b*) is a partially perspective view of the back of the mobile wireless unit. The mobile wireless unit shown in FIGS. 1(*a*) and 1(*b*) includes a first antenna element 102 having an electrical length, which is 0.21 wavelength of a first frequency band. The first antenna element 102 is designed to transmit and received an electromagnetic wave having a frequency in the first frequency band, and to extend outside a case 101. As shown in FIG. 1(*a*), the mobile wireless unit includes, on a front surface of the case 101, a receiver 103 for outputting a sound from a calling terminal, a display section 104 for displaying characters such as a phone number, an input section 105 for inputting a phone number and a character, and a transmitter 106 for receiving a voice of a user.

As shown in FIG. 1(*b*), the mobile wireless unit includes, in the case 101, a first feeder 107 for feeding the first antenna element 102, a first matching circuit 108 for performing impedance matching to match impedance of the first antenna element 102 for the first frequency band, a first wireless communication circuit section 109 for outputting a signal to be transmitted by the first antenna element 102 and inputting a signal received by the first antenna element 102 through the first feeder 107 and the first matching circuit 108, a second antenna element 110 for transmitting and receiving an electromagnetic wave in a second frequency band, a second feeder 111 for feeding the second antenna element 110, a second matching circuit 112 for performing impedance matching to match impedance of the second antenna element 110 for the second frequency band, a second wireless communication circuit section 113 for outputting a signal to be transmitted by the second antenna element 110 and inputting a signal received by the second antenna element 110 through the second feeder 111 and the second matching circuit 112, and a board 114 having an electrical length of 0.27 wavelength of the first frequency band in a longitudinal direction of the board 114 and an electrical length of 0.12 wavelength of the first frequency band in a lateral direction of the board 114. The board 114 is provided with the first feeder 107, the first matching circuit 108, the first wireless communication circuit section 109, the second feeder 111, the second matching circuit 112, and the second wireless communication circuit section 113 and serves as a ground plate of the first antenna element 102 and the second antenna element 110.

Each of the first and second antenna elements 102 and 110 is a monopole antenna. The first and second antenna elements 102 and 110 are designed to extend from the first feeder 107 and the second feeder 111, respectively. As shown in FIG. 1(*b*), the first and second feeders 107 and 111 are separated from each other in a longitudinal direction of the case 101. The second antenna element 110 is placed on the side opposite to the first antenna element 102 with respect to a longitudinal direction of the board 114. The second antenna element 110 and the first antenna element 102 are in spaced relationship with each other, and substantially the same in direction as each other. The electrical length between the first feeder 107 and the second feeder 111 is 0.27 wavelength of the first frequency band, which is the same as the electrical length of the board 114.

The first antenna element 102 and the first wireless communication circuit section 109 are used for a wireless communication system for audio and data communications such as W-CDMA. The second antenna element 110 and the second wireless communication circuit section 113 are used for a wireless communication system including an application such as short-range wireless communications. The SAR is expressed as $\sigma E2/\rho$ as described above. The intensity of an electric field varies depending on radiation power emitted from the mobile wireless unit. Not only the antenna elements function as an antenna, and a high frequency current flows in the entire mobile wireless unit to generate an electromagnetic wave. The high frequency current flowing in the antenna elements and the ground plate thus causes the radiation power.

FIGS. 2(*a*) to 2(*d*) are diagrams each showing a distribution of a high frequency current flowing a conductor, which is an antenna element having an electrical length 1. The frequency of the high frequency current is $\lambda$. The abscissa axis shown in FIGS. 2(*a*) to 2(*d*) indicates the electrical length of the antenna element, and the ordinate axis shown in FIGS. 2(*a*) to 2(*d*) indicates the intensity of the high frequency current. FIG. 2(*a*) shows a distribution of a high frequency current in the case where the electrical length l of the antenna element is smaller than a half wavelength of the frequency $\lambda$ of the high frequency current flowing in the antenna element. FIG. 2(*b*) shows a distribution of a high frequency current in the case where the electrical length l of the antenna element is equal to a half wavelength of the frequency $\lambda$ of the high frequency current flowing in the antenna element. FIG. 2(*c*) shows a distribution of a high frequency current in the case where the electrical length l of the antenna element is larger than a half wavelength of the frequency $\lambda$ of and smaller than one wavelength of the frequency $\lambda$ of the high frequency current flowing in the antenna element. FIG. 2(*d*) shows a distribution of a high frequency current in the case where the electrical length l of the antenna element is equal to one wavelength of the frequency $\lambda$ of the high frequency current flowing in the antenna element. As shown in FIGS. 2(*a*) to 2(*d*), the distribution of the high frequency current flowing in the antenna element has one peak point in the case where the electrical length l of the antenna element is equal to or larger than a quarter wavelength of an operating frequency band and equal to or smaller than a half wavelength of the operating frequency band, and has two peak points in the case where the electrical length l of the antenna element is larger than a half wavelength of the operating frequency band and equal to or smaller than one wavelength of the operating frequency band.

When the peak points of the high frequency current are distributed, the SAR can be reduced with a minimum reduction in the radiation power. As described above, not only the antenna elements function as an antenna, and the high frequency current flows in the mobile wireless unit to generate an electromagnetic wave. When the total of the electrical length of the first antenna element 102 that generates an electromagnetic wave, the electrical length of the second antenna element 110, and the electrical length in the mobile wireless unit is larger than a half wavelength of the first frequency band and equal to or smaller than one wavelength of the first frequency band, the peak points of the high frequency current can be distributed to reduce the SAR. In this case, the electrical length in the mobile wireless unit is defined as an electrical length between the first antenna element 102 and the end portion of the second antenna element 110 in the case 101, that is, the electrical length between the first feeder 107 and the second feeder 111.

Figure 3A:
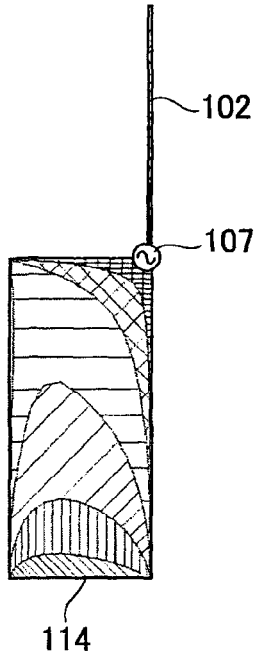
FIGS. 3(*a*) and 3(*b*) are diagrams each showing a distribution of a high frequency current in a first frequency band of the mobile wireless unit shown in FIGS. 1(*a*) and 1(*b*).
Figure 3B:
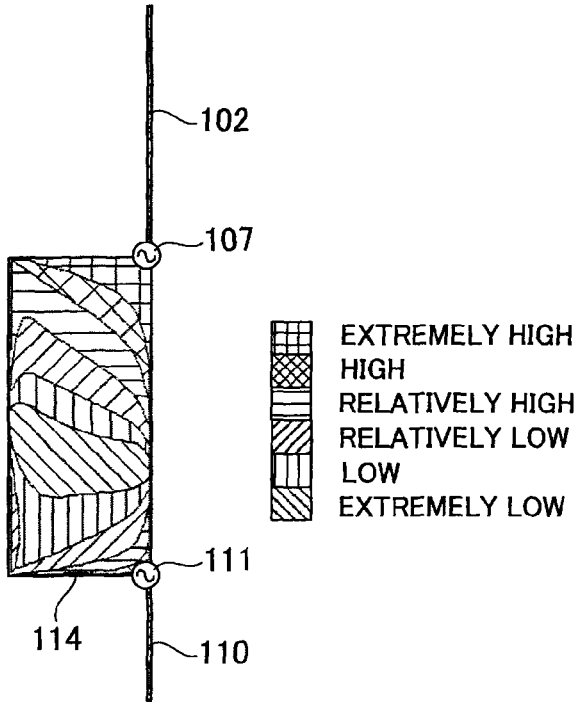
Figure 4:
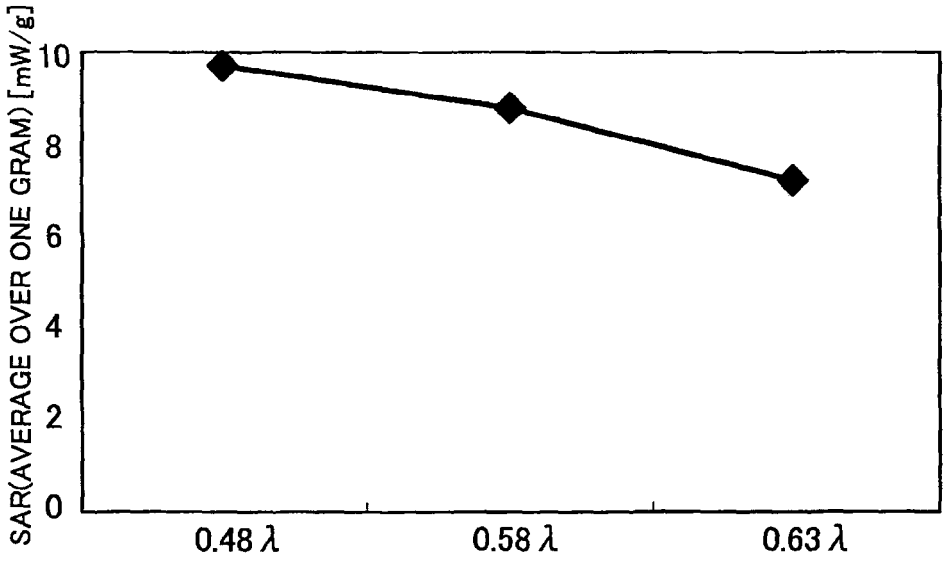
FIG. 4 is a graph showing SAR characteristics for different electrical lengths of a second antenna element shown in FIG. 1(*b*).
Figure 5:
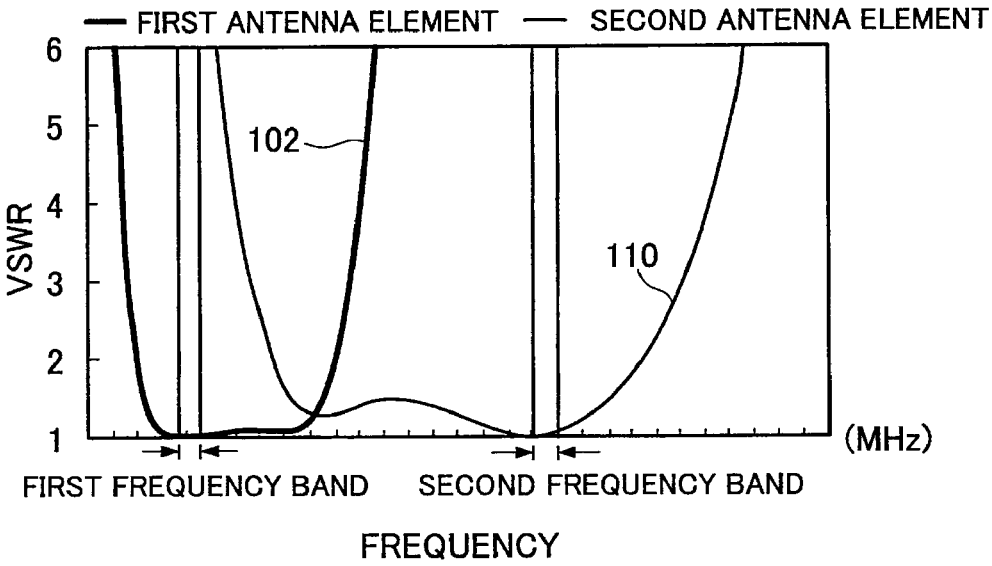
FIG. 5 is a graph showing the relationship between the frequency of the second antenna element and a voltage standing wave ratio (VSWR) corresponding to the frequency under the condition that a second matching circuit shown in FIG. 1(*b*) is adjusted.

FIGS. 3(*a*) and 3(*b*) are diagrams showing a high frequency current. FIG. 3(*a*) shows the mobile wireless unit not having the second antenna element 110, and FIG. 3(*b*) shows the mobile wireless unit having the second antenna element 110. As apparent from FIG. 3(*b*), a high frequency current with a high intensity is more distributed in the mobile wireless unit provided with the second antenna element 110 compared with in the mobile wireless unit which is not provided with the second antenna element 110. FIG. 4 is a graph showing SAR characteristics for different electrical lengths of the second antenna element 110. When the total of the electrical length of the first antenna element 102, the electrical length of the second antenna element 110, the electrical length between the first feeder 107 and the second feeder 111 is $0.63\lambda$, which is larger than a half wavelength of the first frequency band, the SAR is reduced. FIG. 5 is a graph showing the relationship between a frequency transmitted and received by the second antenna element 110 and a voltage standing wave ratio (VSWR).

The electrical length of the second antenna element 110 is determined based on the SAR corresponding to the first frequency band. The frequency band of the second antenna element 110 is not necessarily equal to a desired frequency band used for an application such as short-range wireless communications. The second antenna element 110 is therefore adjusted by the second matching circuit 112 to transmit and receive an electromagnetic wave in the desired frequency band.

The peak points of the high frequency current in the first frequency band are distributed to the vicinities of the first and second feeders 107 and 111 when the electrical length of the second antenna element 110 is adjusted so that the total of the electrical length of the first antenna element 102, the electrical length of the second antenna element 110, and the electrical length between the first feeder 107 and the second feeder 111 is larger than a half wavelength of the first frequency band and equal to or smaller than one wavelength of the first frequency band. As shown in FIG. 4, the electrical length of the second antenna element 110 can be adjusted to reduce the SAR corresponding to the first frequency band by about 10%, and the second matching circuit 107 is adjusted to maintain the VSWR of the second antenna element 110 within the range of 1 to 1.5 in the second frequency band as shown in FIG. 5.

The antenna apparatus according to the first embodiment is constituted by the ground plate, the first antenna element for transmitting and receiving an electromagnetic wave with the first frequency band, the first feeder provided on the ground plate and feeding the first antenna element, the second antenna element for transmitting and receiving an electromagnetic wave with the second frequency band, and the second feeder provided separately from the first feeder on the ground plate and feeding the second antenna element, wherein the first antenna element is designed to extend from the first feeder to the outside of the ground plate, the second antenna element is designed to extend from the second feeder, and the total of the electrical length of the first antenna element, the electrical length of the second antenna element, and the electrical length between the first feeder and the second feeder is larger than a half wavelength of the first frequency band and is equal to or smaller than one wavelength of the first frequency band. The antenna apparatus thus constructed is capable of distributing peak points of the high frequency current, which flows in the mobile wireless unit such as the antenna elements and the ground plate and causes radiation of an electromagnetic wave from the antenna elements and the ground plate, to reduce the SAR without an additional component for reducing the SAR.

Second Embodiment

Figure 6A:
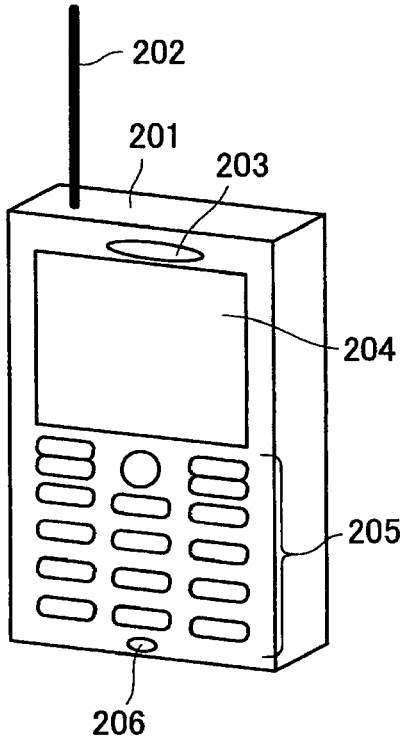
FIGS. 6(*a*) and 6(*b*) are diagrams each showing the construction of a mobile wireless unit mounting an antenna apparatus for a wireless unit according to the second embodiment of the present invention.
Figure 6B:
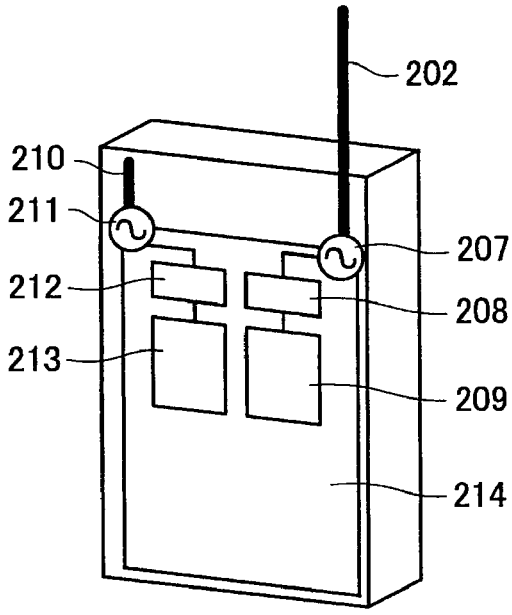

FIGS. 6(*a*) and 6(*b*) are diagrams each showing an outline construction of the mobile wireless unit according to the second embodiment of the present invention. FIG. 6(*a*) is a front view of the mobile wireless unit, and FIG. 6(*b*) is a partially perspective view of the back of the mobile wireless unit. As shown in FIGS. 6(*a*) and 6(*b*), the mobile wireless unit according to the second embodiment includes a first antenna element 202 having an electrical length of 0.21 wavelength of the first frequency band. The first antenna element 202 is designed to extend outside a case 201. As shown in FIG. 6(*a*), the mobile wireless unit according to the second embodiment includes, on a front surface of the case 201, a receiver 203 for outputting a sound from a calling terminal, a display section 204 for displaying characters such as a phone number, an input section 205 for inputting a phone number and a character, and a transmitter 206 for receiving a voice of a user.

As shown in FIG. 6(*b*), the mobile wireless unit includes, in the case 201, a first feeder 207 for feeding the first antenna element 202, a first matching circuit 208 for performing impedance matching to match impedance of the first antenna element 202 for the first frequency band, a first wireless communication circuit section 209 for outputting a signal to be transmitted by the first antenna element 202 and inputting a signal received by the first antenna element 202 through the first feeder 207 and the first matching circuit 208, a second antenna element 210 for transmitting and receiving an electromagnetic wave in a second frequency band, a second feeder 211 for feeding the second antenna element 210, a second matching circuit 212 for performing impedance matching to match impedance of the second antenna element 210 for the second frequency band, a second wireless communication circuit section 213 for outputting a signal to be transmitted by the second antenna element 210 and inputting a signal received by the second antenna element 210 through the second feeder 211 and the second matching circuit 212, and a board 214 having an electrical length of 0.54 wavelength of the first frequency band in a longitudinal direction of the board 214 and an electrical length of 0.24 wavelength of the first frequency band in a lateral direction of the board 214. The board 214 is provided with the first feeder 207, the first matching circuit 208, the first wireless communication circuit section 209, the second feeder 211, the second matching circuit 212, and the second wireless communication circuit section 213 and serves as a ground plate of the first antenna element 202 and the second antenna element 210.

Each of the first and second antenna elements 202 and 210 is a monopole antenna and is designed to extend from the first feeder 207 and the second feeder 211, respectively. As shown in FIG. 6(*b*), the first feeder 207 and the second feeder 211 are separated from each other in a longitudinal direction of the case 201. The second antenna element 210 is placed on the side opposite to the first antenna element 202 with respect to a lateral direction of the board 214. The first and second antenna elements 202 and 210 extend substantially in parallel relationship to each other. The electrical length between the first feeder 207 and the second feeder 211 is 0.24 wavelength of the first frequency band, which is the same as the electrical length of the board 214.

The first antenna element 202 and the first wireless communication circuit section 209 may be used for a wireless communication system for audio and data communications such as PDC and W-CDMA. The second antenna element 210 and the second wireless communication circuit section 213 may be used for a wireless communication system including an application such as short-range wireless communications.

Figure 7A:
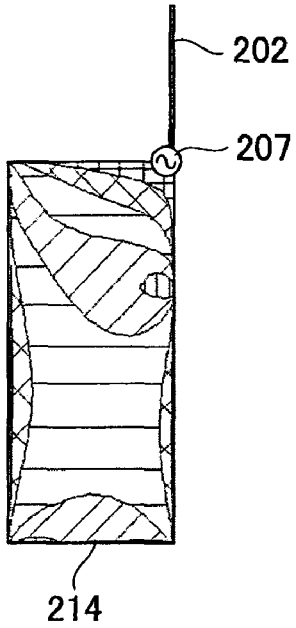
FIGS. 7(*a*) and 7(*b*) are diagrams each showing a distribution of a high frequency current in the first frequency band of the mobile wireless unit shown in FIGS. 6(*a*) and 6(*b*).
Figure 7B:
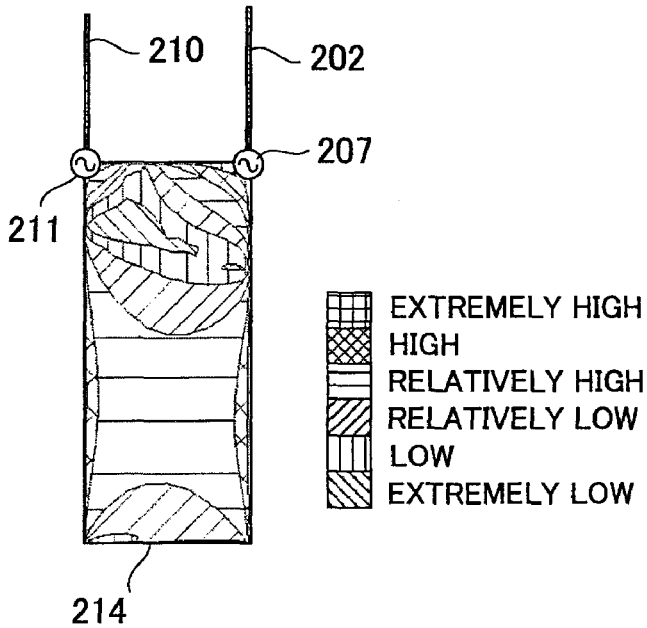

FIGS. 7(*a*) and 7(*b*) are diagrams each showing a distribution of a high frequency current. FIG. 7(*a*) shows the mobile wireless unit not having the second antenna element 210, and FIG. 7(*b*) shows the mobile wireless unit having the second antenna element 210. In the case of a high-frequency wave of, for example, 2 GHz, which is used for a communication system such as W-CDMA, a high frequency current flows not only in a longitudinal direction but also in a lateral direction of the board 214, as shown in FIG. 7(*a*). In FIG. 7(*b*), the peak points of the high frequency current in the first frequency band are distributed to the vicinities of the first and second feeders 207 and 211 since the second antenna element 210 is placed on the side opposite to the first antenna element 202 with respect to the lateral direction of the board 214.

Figure 8:
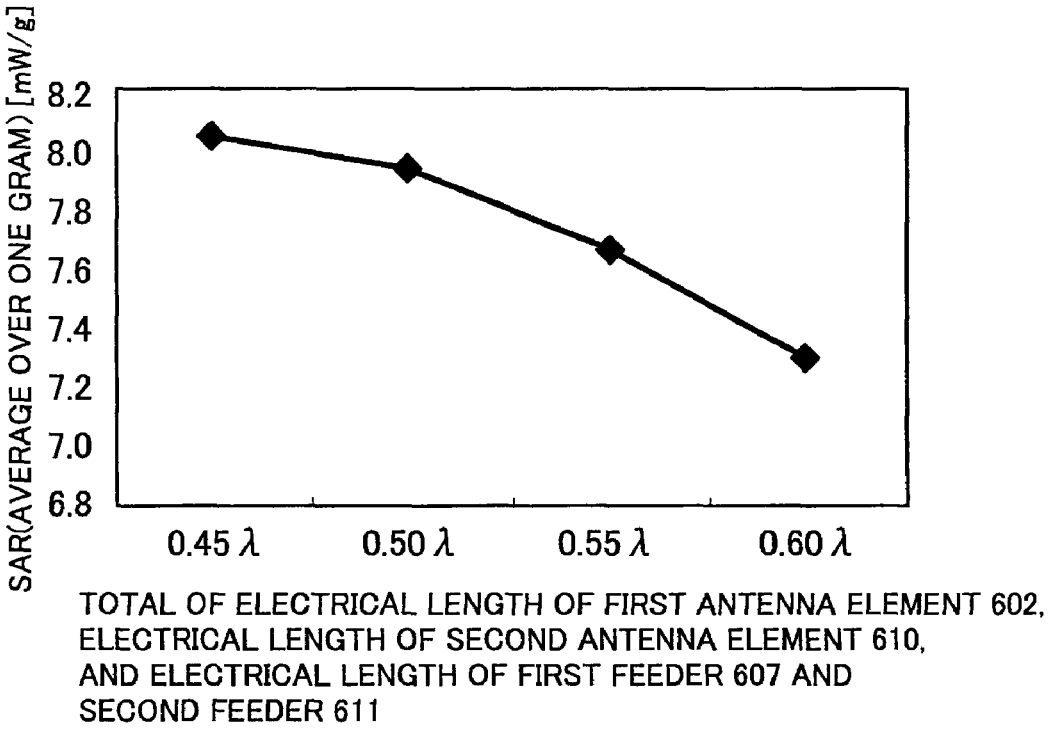
FIG. 8 is a graph showing SAR characteristics corresponding to different electrical lengths of a second antenna element shown in FIG. 6(*b*).
Figure 9:
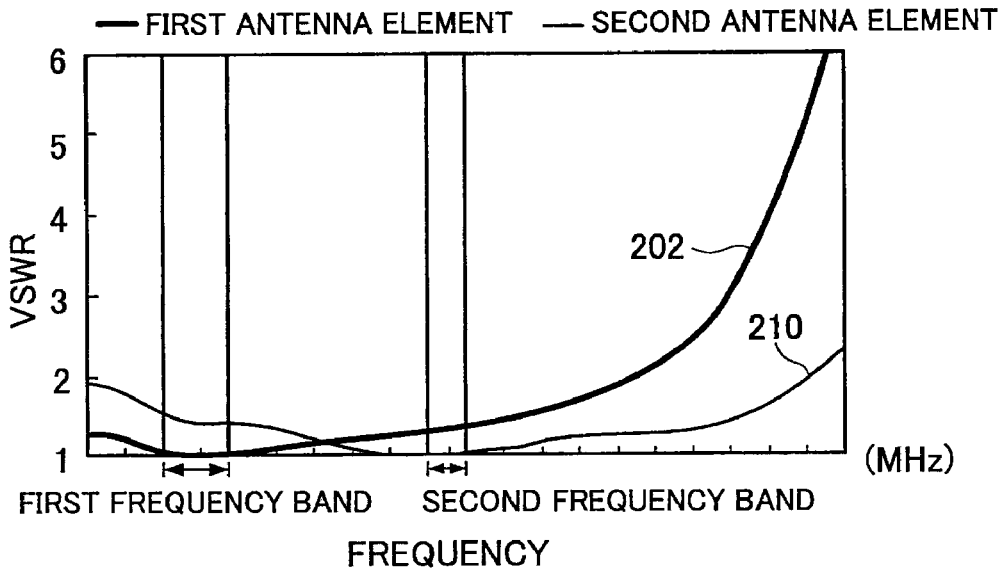
FIG. 9 is a graph showing the relationship between the frequency of the second antenna element and a VSWR corresponding to the frequency under the condition that a second matching circuit shown in FIG. 6(*b*) is adjusted.

FIG. 8 is a graph showing SAR characteristics corresponding to different electrical lengths of the second antenna element 210. FIG. 9 is a graph showing the relationship between a frequency of the second antenna element 210 and a VSWR corresponding to the frequency.

The electrical length of the second antenna element 210 is determined based on the SAR corresponding to the first frequency band. The frequency band of the second antenna element 110 is not necessarily equal to a desired frequency band used for an application such as short-range wireless communications. The second antenna element 210 is therefore adjusted by the second matching circuit 212 to transmit and receive an electromagnetic wave in the desired frequency band.

The electrical length of the second antenna element 210 is adjusted so that the total of the electrical length of the first antenna element 202, the electrical length of the second antenna element 210, and the electrical length between the first feeder 207 and the second feeder 211 is larger than a half wavelength of the first frequency band and equal to or smaller than one wavelength of the first frequency band to reduce the SAR corresponding to the first frequency band by about 10%, and the second matching circuit 212 is adjusted to maintain the VSWR of the second antenna element 210 within the range of 1 to 1.3 in the second frequency band as shown in FIG. 9.

In the present embodiment, each of the first and second antenna elements 202 and 210 extends in a substantially longitudinal direction of the board 214. The present invention is not limited to the abovementioned construction. The first antenna element 202 and the second antenna element 210 may extend unless they extend with decreasing a distance between them. The first antenna element 202 and the second antenna element 210 may extend with increasing the distance between them.

The antenna apparatus thus constructed according to the second embodiment is constituted by the ground plate, the first antenna element for transmitting and receiving an electromagnetic wave in the first frequency band, the first feeder provided on the ground plate and feeding the first antenna element, the second antenna element for transmitting and receiving an electromagnetic wave with the second frequency band, and the second feeder provided separately from the first feeder on the ground plate and feeding the second antenna element, wherein the first antenna element is designed to extend from the first feeder to the outside of the ground plate, the second antenna element is designed to extend from the second feeder, and the total of the electrical length of the first antenna element, the electrical length of the second antenna element, and the electrical length between the first feeder and the second feeder is larger than a half wavelength of the first frequency band and is equal to or smaller than one wavelength of the first frequency band. The antenna apparatus thus constructed according to the present invention is capable of distributing peak points of a high frequency current, which flows in the mobile wireless unit such as the antenna elements and the ground plate and causes radiation of an electromagnetic wave from the antenna elements and the ground plate, to reduce the SAR without an additional component for reducing the SAR.

The second antenna element and the first antenna element are designed to extend in substantially the same direction or to extend with increasing the distance between them to reduce interference between the antenna elements.

Third Embodiment

Figure 10A:
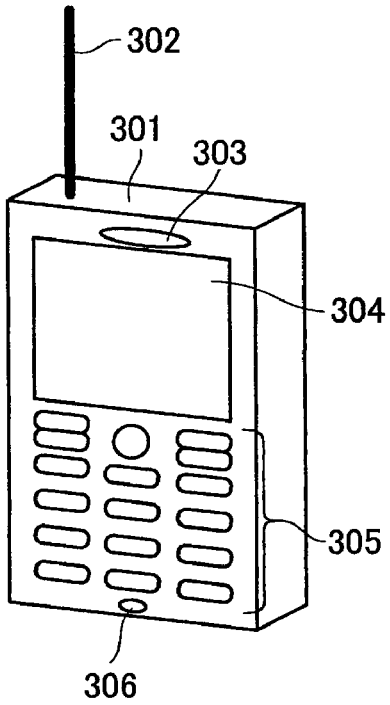
FIGS. 10(*a*) and 10(*b*) are diagrams each showing the construction of a mobile wireless unit mounting an antenna apparatus for a wireless unit according to the third embodiment of the present invention.
Figure 10B:
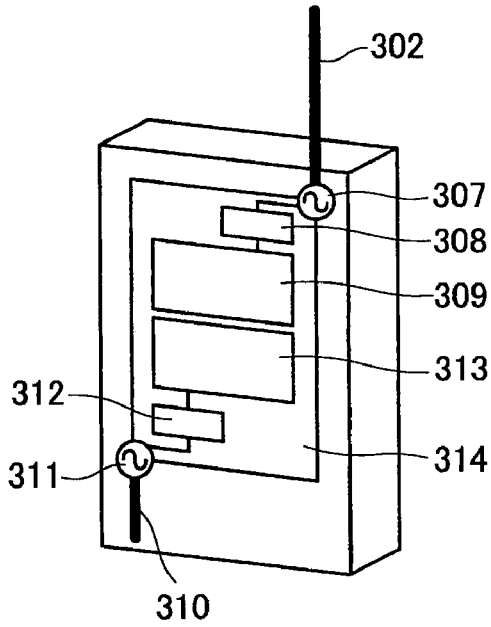

FIGS. 10(*a*) and 10(*b*) are diagrams each showing an outline construction of a mobile wireless unit according to the third embodiment of the present invention. FIG. 10(*a*) is a front view of the mobile wireless unit, and FIG. 10(*b*) is a partially perspective view of the back of the mobile wireless unit. As shown in FIGS. 10(*a*) and 10(*b*), the mobile wireless unit according to the third embodiment includes a first antenna element 302 having an electrical length of 0.12 wavelength of the first frequency band. The mobile wireless unit according to the third embodiment includes, on the front surface of the case 301, a receiver 303 for outputting a sound from a calling terminal, a display section 304 for displaying characters such as a phone number, an input section 305 for inputting a phone number and a character, and a transmitter 306 for receiving a voice of a user as shown in FIG. 10(*a*).

The antenna apparatus according to the third embodiment includes, in the case 301, a first feeder 307 for feeding the first antenna element 302, a first matching circuit 308 for performing impedance matching to match impedance of the first antenna element 302 for the first frequency band, a first wireless communication circuit section 309 for outputting a signal to be transmitted by the first antenna element 302 and inputting a signal received by the first antenna element 302 through the first feeder 307 and the first matching circuit 308, a second antenna element 310 having an electrical length of 0.15 wavelength of the first frequency band, a second feeder 311 for feeding the second antenna element 310, a second matching circuit 312 for performing impedance matching to match impedance of the second antenna element 310 for the second frequency band, a second wireless communication circuit section 313 for outputting a signal to be transmitted by the second antenna element 310 and inputting a signal received by the second antenna element 310 through the second feeder 311 and the second matching circuit 312, and a board 314 having an electrical length of 0.27 wavelength of the first frequency band in a longitudinal direction of the board 314 and an electrical length of 0.12 wavelength of the first frequency band in a lateral direction of the board 314. The board 314 is provided with the first feeder 307, the first matching circuit 308, the first wireless communication circuit section 309, the second feeder 311, the second matching circuit 312, and the second wireless communication circuit section 313 and serves as a ground plate of the first antenna element 302 and the second antenna element 310.

Each of the first and second antenna elements 302 and 310 is a monopole antenna and is designed to extend from the first feeder 307 and the second feeder 311, respectively. As shown in FIG. 10(*b*), since the first and second feeders 307 and 311 are located in symmetrical relationship to each other with respect to the center of a diagonal line of the board 314, the first and second antenna elements 302 and 310 are located in symmetrical relationship to each other with respect to the center of the diagonal line of the board 314 and extend in parallel relationship to each other.

The electrical length between the first and second feeders 307 and 311 in a longitudinal direction of the board 314 is 0.27 wavelength of the first frequency band, which is the same as the length of the board 314. The electrical length between the first and second feeders 307 and 311 in a lateral direction of the board 314 is 0.12 wavelength of the first frequency band, which is the same as the width of the board 314.

The first antenna element 302 and the first wireless communication circuit section 309 may be used for a wireless communication system for audio and data communications such as W-CDMA. The second antenna element 310 and the second wireless communication circuit section 313 may be used for a wireless communication system including an application such as short-range wireless communications.

Figure 11A:
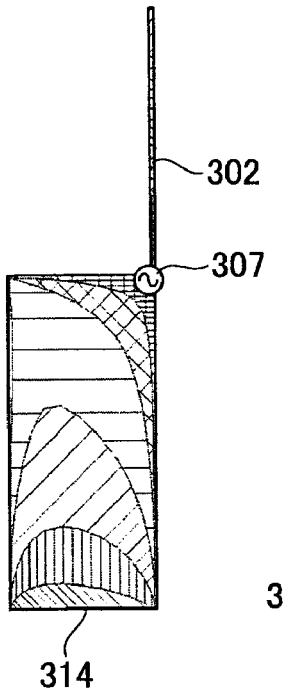
FIGS. 11(*a*) and 11(*b*) are diagrams each showing a distribution of a high frequency current in the first frequency band of the mobile wireless unit shown in FIGS. 10(*a*) and 10(*b*).
Figure 11B:
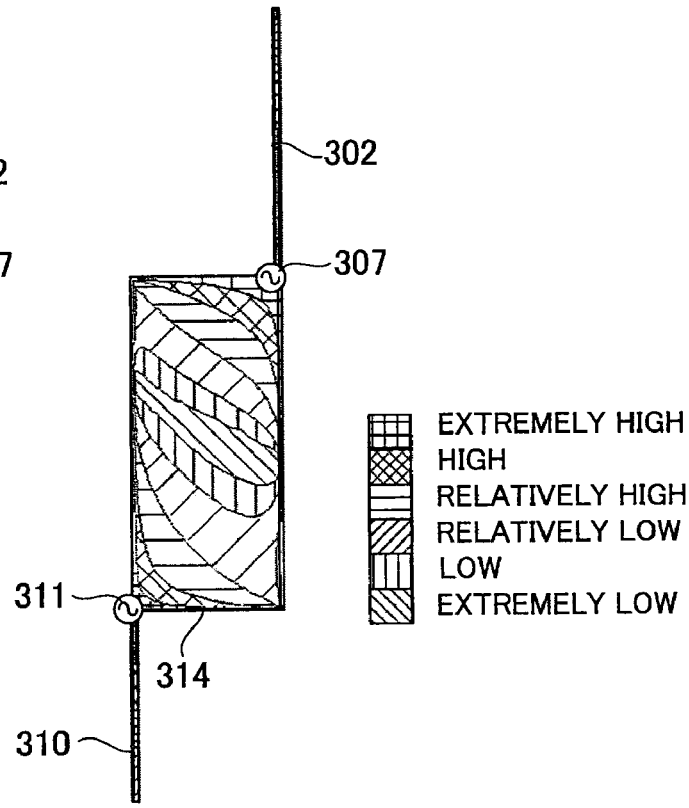

FIGS. 11(*a*) and 11(*b*) are diagrams each showing a distribution of a high frequency current. FIG. 11(*a*) shows the mobile wireless unit not having the second antenna element 310, and FIG. 11(*b*) shows the mobile wireless unit having the second antenna element 310. The second antenna element 310 and the second feeder 311 are located in symmetrical relationship to the first antenna element 302 and the first feeder 307 with respect to the diagonal line of the board 314. This results in the fact that peak points of the high frequency current in the first frequency band are distributed to the vicinities of the first and second feeders 307 and 311 as shown in FIG. 11(*b*).

The electrical length of the second antenna element 310 is determined based on the SAR corresponding to the first frequency band. The frequency band of the second antenna element 310 is not necessarily equal to a desired frequency band used for an application such as short-range wireless communications. The second antenna element 310 is therefore adjusted by the second matching circuit 312 to transmit and receive an electromagnetic wave in the desired frequency band.

Figure 12:
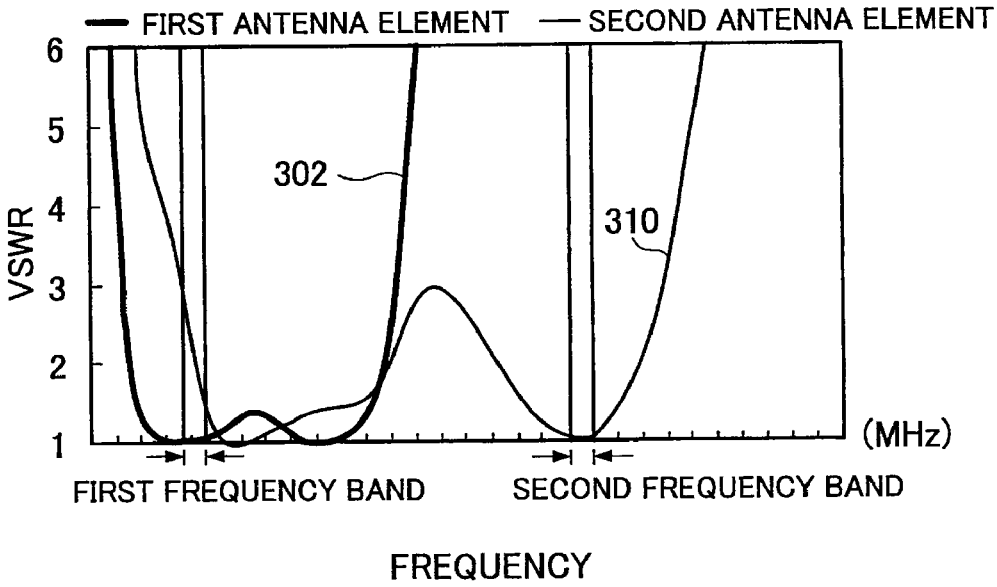
FIG. 12 is a graph showing the relationship between a frequency of a second antenna element shown in FIG. 10(*b*) and a VSWR corresponding to the frequency under the condition that a second matching circuit shown in FIG. 10(*b*) is adjusted.

In the antenna apparatus shown in FIGS. 10(*a*) and 10(*b*), the total of the electrical length of the first antenna element 302, the electrical length of the second antenna element 310, and the electrical length between the first and second feeders 307 and 311 is 0.75 wavelength of the first frequency band, which is larger than a half wavelength of the first frequency band and small than one wavelength of the first frequency band. In this case, the SAR corresponding to the first frequency band is reduced by 15%, and the second matching circuit 312 is adjusted to maintain the VSWR of the second antenna element within the range of 1 to 1.1 in the second frequency band as shown in FIG. 12.

The antenna apparatus thus constructed according to the third embodiment is constituted by the ground plate, the first antenna element for transmitting and receiving an electromagnetic wave in the first frequency band, the first feeder provided on the ground plate and feeding the first antenna element, the second antenna element for transmitting and receiving an electromagnetic wave in the second frequency band, and the second feeder provided separately from the first feeder on the ground plate and feeding the second antenna element, wherein the first antenna element is designed to extend from the first feeder to the outside of the ground plate, the second antenna element is designed to extend from the second feeder, and the total of the electrical length of the first antenna element, the electrical length of the second antenna element, and the electrical length between the first feeder and the second feeder is larger than a half wavelength of the first frequency band and is equal to or smaller than one wavelength of the first frequency band. The antenna apparatus thus constructed is capable of distributing peak points of the high frequency current, which flows in the mobile wireless unit such as the antenna elements and the ground plate and causes radiation of an electromagnetic wave from the antenna elements and the ground plate, to reduce the SAR without an additional component for reducing the SAR.

The first and second feeders are located in symmetrical relationship to each other with respect to the center of the ground plate to effectively distribute peak points of the high frequency current, which flows from the antenna elements through the ground plate to the entire wireless unit and causes radiation of an electromagnetic wave from the antenna elements and the ground plate.

Fourth Embodiment

Figure 13A:
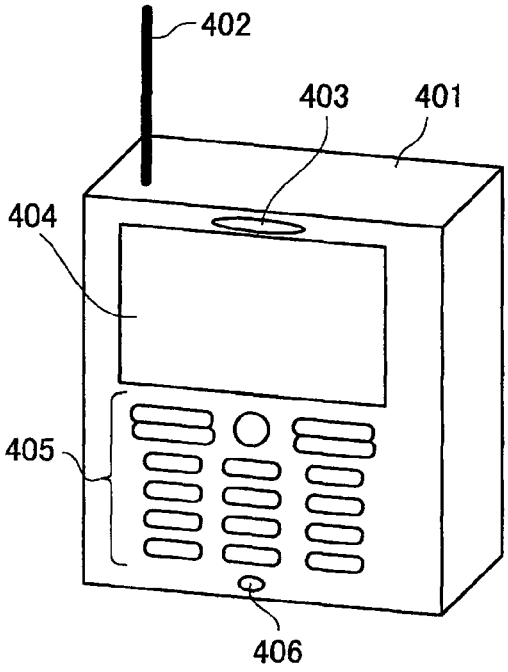
FIGS. 13(*a*) and 13(*b*) are diagrams each showing the construction of a mobile wireless unit mounting an antenna apparatus for a wireless unit according to the fourth embodiment of the present invention.
Figure 13B:
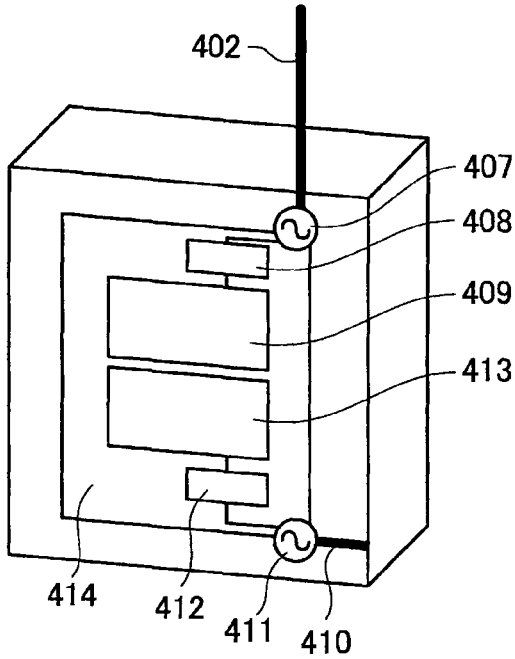

FIGS. 13(*a*) and 13(*b*) are diagrams each showing an outline construction of a mobile wireless unit according to the fourth embodiment of the present invention. FIG. 13(*a*) is a front view of the mobile wireless unit, and FIG. 13(*b*) is a partially perspective view of the back of the mobile wireless unit. The mobile wireless unit according to the fourth embodiment includes a first antenna element 402 having an electrical length of 0.12 wavelength of the first frequency band. The first antenna element 402 extends outside a case 401. As shown in FIG. 13(*a*), the mobile wireless unit according to the fourth embodiment includes, on the front surface of the case 401, a receiver 403 for outputting a sound from a calling terminal, a display section 404 for displaying characters such as a phone number, an input section 405 for inputting a phone number and a character, and a transmitter 406 for receiving a voice of a user.

As shown in FIG. 13(*b*), the mobile wireless unit includes, in the case 401, a first feeder 407 for feeding the first antenna element 402, a first matching circuit 408 for performing impedance matching to match impedance of the first antenna element 402 for the first frequency band, a first wireless communication circuit section 409 for outputting a signal to be transmitted by the first antenna element 402 and inputting a signal received by the first antenna element 402 through the first feeder 407 and the first matching circuit 408, a second antenna element 410 having an electrical length of 0.15 wavelength of the first frequency, a second feeder 411 for feeding the second antenna element 410, a second matching circuit 412 for performing impedance matching to match impedance of the second antenna element 410 for the second frequency band, a second wireless communication circuit section 413 for outputting a signal to be transmitted by the second antenna element 410 and inputting a signal received by the second antenna element 410 through the second feeder 411 and the second matching circuit 412, and a board 414 having an electrical length of 0.27 wavelength of the first frequency band in a longitudinal direction of the board 414 and an electrical length of 0.12 wavelength of the first frequency band in a lateral direction of the board 414. The board 414 is provided with the first feeder 407, the first matching circuit 408, the first wireless communication circuit section 409, the second feeder 411, the second matching circuit 412, and the second wireless communication circuit section 413 and serves as a ground plate of the first antenna element 402 and the second antenna element 410.

Each of the first and second antenna elements 402 and 410 is a monopole antenna and is designed to extend from the first feeder 407 and the second feeder 411, respectively. As shown in FIG. 13(*b*), the first feeder 407 and the second feeder 411 are separated from each other in the longitudinal direction of the case 401. The second antenna element 410 is placed on the side opposite to the first antenna element 402 with respect to the longitudinal direction of the board 414. The first and second antenna elements 402 and 410 are substantially in perpendicular relationship with each other. The electrical length between the first feeder 407 and the second feeder 411 is 0.27 wavelength of the first frequency band, which is the same as the electrical length of the board 414 in the longitudinal direction of the board 414.

The first antenna element 402 and the first wireless communication circuit section 409 may be used for a wireless communication system for audio and data communications such as W-CDMA. The second antenna element 410 and the first wireless communication circuit section 409 may be used for a wireless communication system including an application such as short-range wireless communications.

Figure 14A:
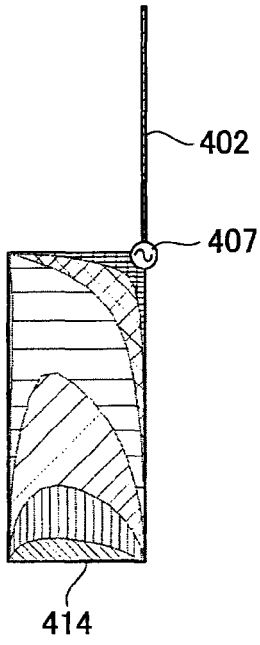
FIGS. 14(*a*) and 14(*b*) are diagrams each showing a distribution of a high frequency current in the first frequency band of the mobile wireless unit shown in FIGS. 13(*a*) and 13(*b*).
Figure 14B:
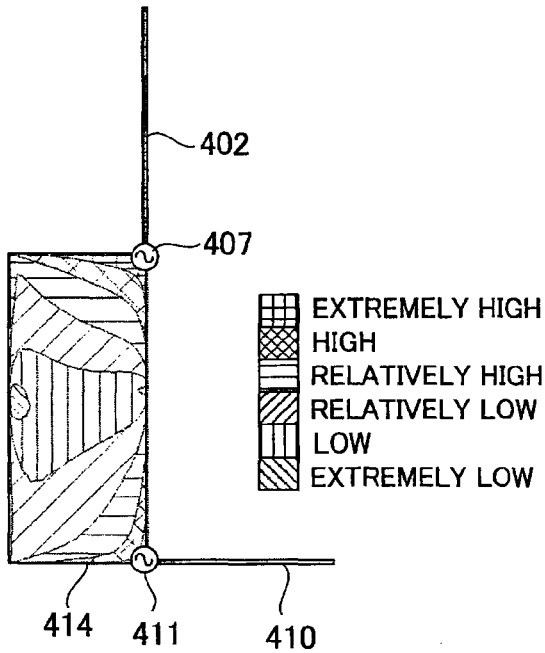

FIGS. 14(*a*) and 14(*b*) are diagrams each showing a distribution of a high frequency current. FIG. 14(*a*) shows the mobile wireless unit not having the second antenna element 410, and FIG. 14(*b*) shows the mobile wireless unit having the second antenna element 410. The second antenna element 410 is positioned on the side opposite to the first antenna element 402 with respect to the longitudinal direction of the board 414, resulting in the fact that peak points of the high frequency current in the first frequency band are distributed to the vicinities of the first and second feeders 407 and 411 as shown in FIG. 14(*b*).

The electrical length of the second antenna element 410 is determined based on the SAR corresponding to the first frequency band. Thus, the frequency band of the second antenna element is not necessarily equal to a desired frequency band used for an application such as short-range wireless communications. The second antenna element 410 is therefore adjusted by the second matching circuit 412 to transmit and receive an electromagnetic wave in the desired frequency band.

Figure 15:
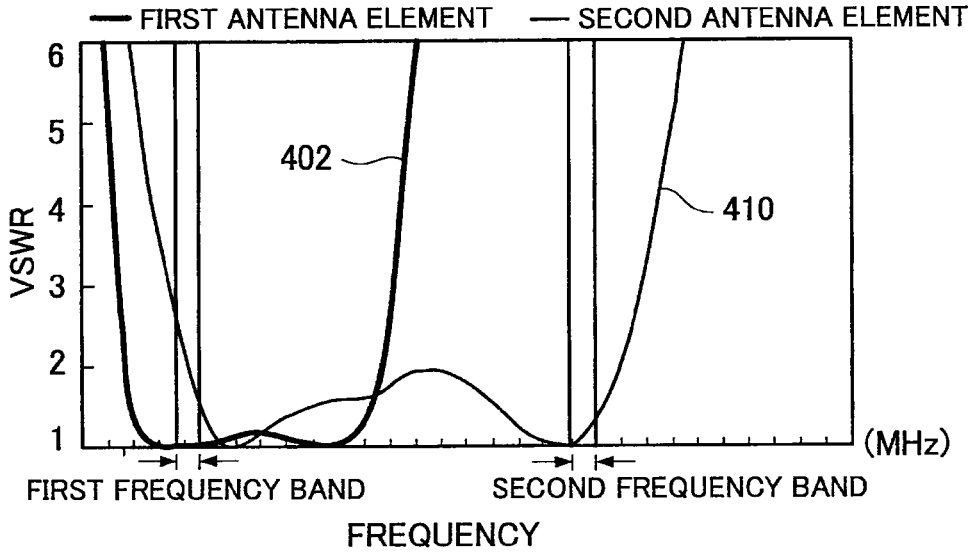
FIG. 15 is a graph showing the relationship between a frequency of a second antenna element shown in FIG. 13(*b*) and a VSWR corresponding to the frequency under the condition that a second matching circuit shown in FIG. 13(*b*) is adjusted.

In the antenna apparatus shown in FIGS. 13(*a*) and 13(*b*), the total of the electrical length of the first antenna length 402, the electrical length of the second antenna length 410, and the electrical length between the first and second feeders 407 and 411 is 0.63 wavelength of the first frequency band, which is larger than a half wavelength of the first frequency band and smaller than one wavelength of the first frequency band. In this case, the SAR corresponding to the first frequency band is reduced by 15%, and the second matching circuit 412 is adjusted to maintain the VSWR of the second antenna element within the range of 1 to 1.3 in the second frequency band as shown in FIG. 15.

The antenna apparatus thus constructed according to the fourth embodiment is constituted by the ground plate, the first antenna element for transmitting and receiving an electromagnetic wave in the first frequency band, the first feeder provided on the ground plate and feeding the first antenna element, the second antenna element for transmitting and receiving an electromagnetic wave in the second frequency band, and the second feeder provided separately from the first feeder on the ground plate and feeding the second antenna element, wherein the first antenna element is designed to extend from the first feeder to the outside of the ground plate, the second antenna element is designed to extend from the second feeder, and the total of the electrical length of the first antenna element, the electrical length of the second antenna element, and the electrical length between the first and second feeders is larger than a half wavelength of the first frequency band and is equal to or smaller than one wavelength of the first frequency band. The antenna apparatus thus constructed is capable of distributing peak points of the high frequency current, which flows in the mobile wireless unit such as the antenna elements and the ground plate and causes radiation of an electromagnetic wave from the antenna elements and the ground plate, to reduce the SAR without an additional component for reducing the SAR.

The first and second antenna elements are substantially in perpendicular relationship with each other to reduce the degree of coupling between the first and second antenna elements.

Fifth Embodiment

Figure 16A:
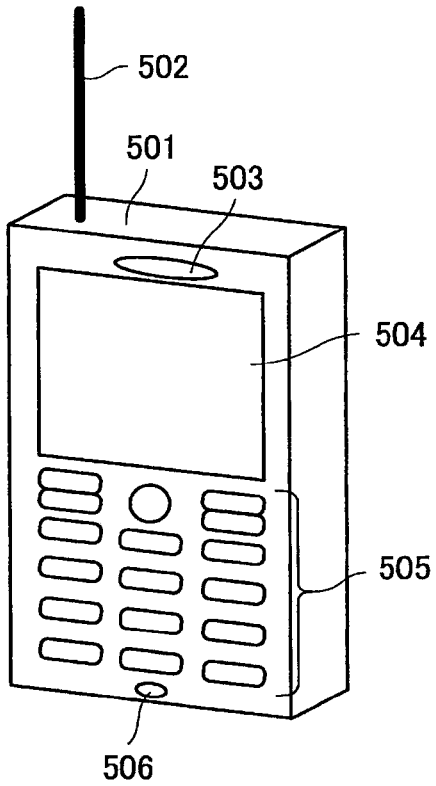
FIGS. 16(*a*) and 16(*b*) are diagrams each showing the construction of a mobile wireless unit mounting an antenna apparatus for a wireless unit according to the fifth embodiment of the present invention.
Figure 16B:
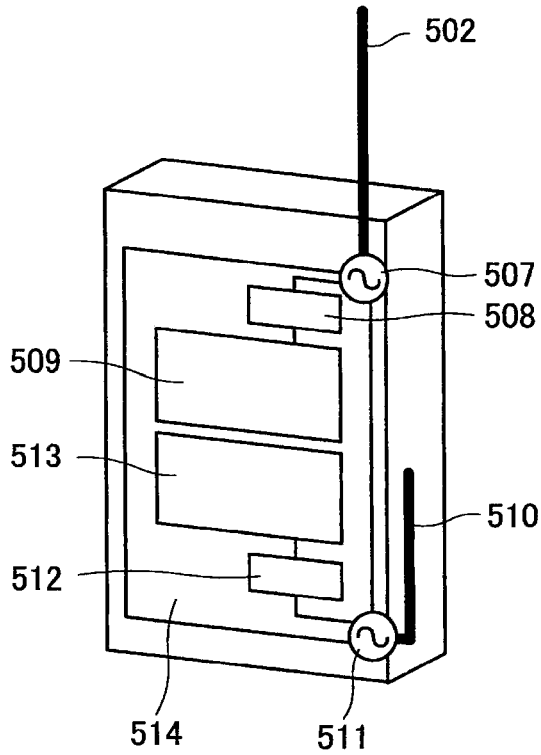

FIGS. 16(*a*) and 16(*b*) are diagrams each showing an outline construction of a mobile wireless unit according to the fifth embodiment of the present invention. FIG. 16(*a*) is a front view of the mobile wireless unit, and FIG. 16(*b*) is a partially perspective view of the back of the mobile wireless unit. The mobile wireless unit according to the fifth embodiment includes a first antenna element 502 having an electrical length of 0.12 wavelength of the first frequency band and extending outside a case 501 as shown in FIG. 16(*a*). The mobile wireless unit according to the fifth embodiment includes, on the front surface of the case 501, a receiver 503 for outputting a sound from a calling terminal, a display section 504 for displaying characters such as a phone number, an input section 505 for inputting a phone number and a character, and a transmitter 506 for receiving a voice of a user.

As shown in FIG. 16(*b*), the mobile wireless unit includes, in the case 501, a first feeder 507 for feeding the first antenna element 502, a first matching circuit 508 for performing impedance matching to match impedance of the first antenna element 502 for the first frequency band, a first wireless communication circuit section 509 for outputting a signal to be transmitted by the first antenna element 502 and inputting a signal received by the first antenna element 502 through the first feeder 507 and the first matching circuit 508, a second antenna element 510 having an electrical length of 0.15 wavelength of the first frequency, a second feeder 511 for feeding the second antenna element 510, a second matching circuit 512 for performing impedance matching to match impedance of the second antenna element 510 for the second frequency band, a second wireless communication circuit section 513 for outputting a signal to be transmitted by the second antenna element 510 and inputting a signal received by the second antenna element 510 through the second feeder 511 and the second matching circuit 512, and a board 514 having an electrical length of 0.27 wavelength of the first frequency band in a longitudinal direction of the board 514 and an electrical length of 0.12 wavelength of the first frequency band in a lateral direction of the board 514. The board 514 is provided with the first feeder 507, the first matching circuit 508, the first wireless communication circuit section 509, the second feeder 511, the second matching circuit 512, and the second wireless communication circuit section 513 and serves as a ground plate of the first antenna element 502 and the second antenna element 510.

Figures 17A, 17B:
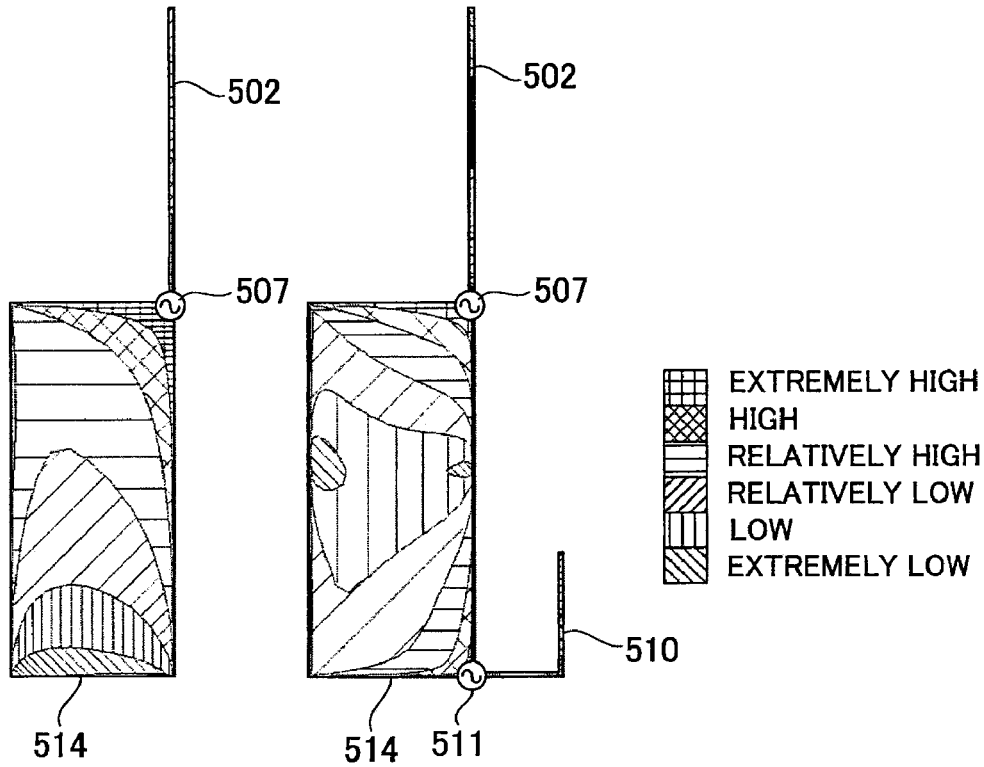
FIGS. 17(*a*) and 17(*b*) are diagrams each showing a distribution of a high frequency current in the first frequency band of the mobile wireless unit shown in FIGS. 16(*a*) and 16(*b*).

The first antenna element 502 is a monopole antenna, while the second antenna element 510 has the shape of inverted-L. The first antenna element 502 is designed to extend from the first feeder 507, while the second antenna element 511 is designed to extend from the second feeder 511. As shown in FIG. 17(*b*), since the first and second feeders 507 and 511 are separated from each other in a longitudinal direction of the board 514, the second antenna element 510 is positioned on the side opposite to the first antenna element 502 with respect to the longitudinal direction of the board 514. The electrical length between the first and second feeders 507 and 511 is equal to 0.27 wavelength of the first frequency band, which is the same as the electrical length of the board 514. in the longitudinal direction of the board 514.

FIGS. 17(*a*) and 17(*b*) are diagrams each showing a distribution of a high frequency current. FIG. 17(*a*) shows the mobile wireless unit not having the second antenna element 510, and FIG. 17(*b*) shows the mobile wireless unit having the second antenna element 510. The second antenna element 510 is positioned on the side opposite to the first antenna element 502 with respect to the longitudinal direction of the board 514, resulting in the fact that peak points of the high frequency current in the first frequency band are distributed to the vicinities of the first and second feeders 507 and 511 as shown in FIG. 17(*b*)

The electrical of the second antenna element 510 is determined based on the SAR corresponding to the first frequency band. The frequency band of the second antenna element 510 is not necessarily equal to a desired frequency band used for an application such as short-range wireless communications. The second antenna element 510 is therefore adjusted by the second matching circuit 512 to transmit and receive an electromagnetic wave in the desired frequency band.

Figure 18:
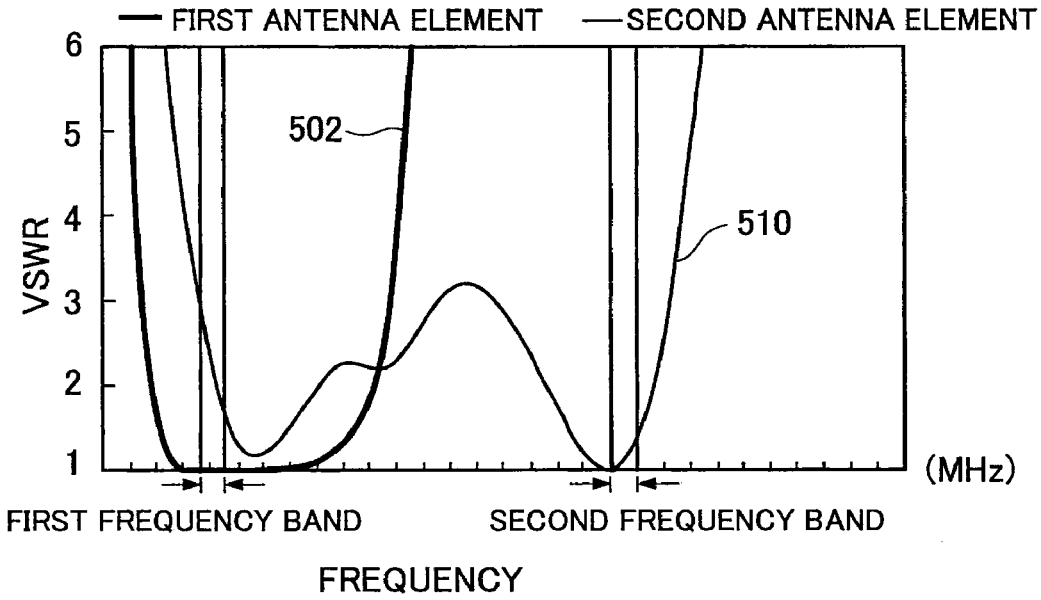
FIG. 18 is a graph showing the relationship between a frequency of a second antenna element shown in FIG. 16(*b*) and a VSWR corresponding to the frequency under the condition that a second matching circuit shown in FIG. 16(*b*) is adjusted.

In the antenna apparatus shown in FIGS. 16(*a*) and 16(*b*), the total of the electrical length of the first antenna element 502, the electrical length of the second antenna element 510, and the electrical length between the first and second feeders 507 and 511 is equal to 0.63 wavelength of the first frequency band, which is larger than a half wavelength of the first frequency band and smaller than one wavelength of the first frequency band. In this case, the SAR corresponding to the first frequency band is reduced by 15%, and the second matching circuit 512 is adjusted to maintain the VSWR of the second antenna element 510 within the range of 1 to 1.4 in the second frequency band as shown in FIG. 18.

The antenna apparatus thus constructed according to the fifth embodiment is constituted by the ground plate, the first antenna element for transmitting and receiving an electromagnetic wave in the first frequency band, the first feeder provided on the ground plate and feeding the first antenna element, the second antenna element for transmitting and receiving an electromagnetic wave in the second frequency band, and the second feeder provided separately from the first feeder on the ground plate and feeding the second antenna element, wherein the first antenna element is designed to extend from the first feeder to the outside of the ground plate, the second antenna element is designed to extend from the second feeder, and the total of the electrical length of the first antenna element, the electrical length of the second antenna element, and the electrical length between the first feeder and the second feeder is larger than a half wavelength of the first frequency band and is equal to or smaller than one wavelength of the first frequency band. The antenna apparatus thus constructed is capable of distributing peak points of the high frequency current, which flows in the mobile wireless unit such as the antenna elements and the ground plate and causes radiation of an electromagnetic wave from the antenna elements and the ground plate, to reduce the SAR without an additional component for reducing the SAR.

In the fifth embodiment, the inverted-L antenna is used as the second antenna element. The inverted-L antenna, however, may be replaced with a linear antenna using a ground plate, such as a helical antenna to obtain a similar effect to that of the inverted-L antenna.

Sixth Embodiment

Figure 19A:
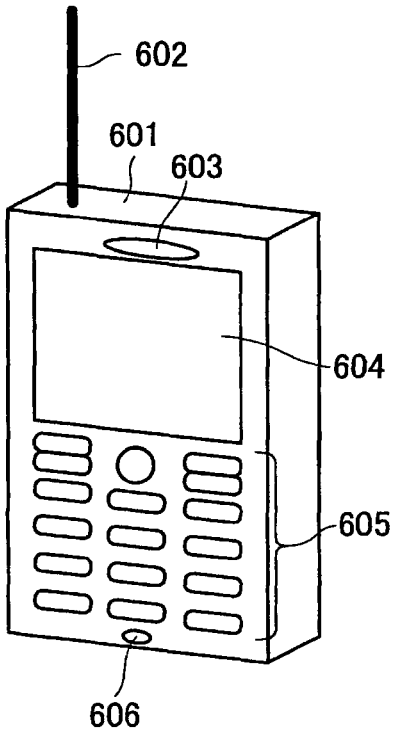
FIGS. 19(*a*) to 19(*c*) are diagrams each showing a mobile wireless unit mounting an antenna apparatus for a wireless unit according to the sixth embodiment of the present invention.
Figure 19B:
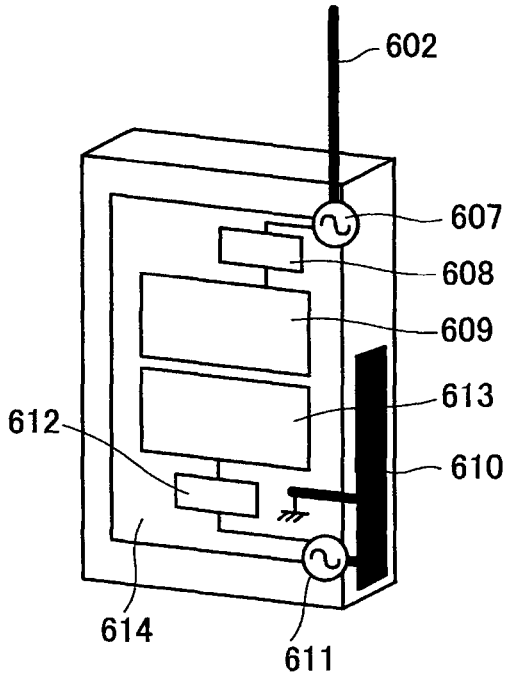
Figure 19C:
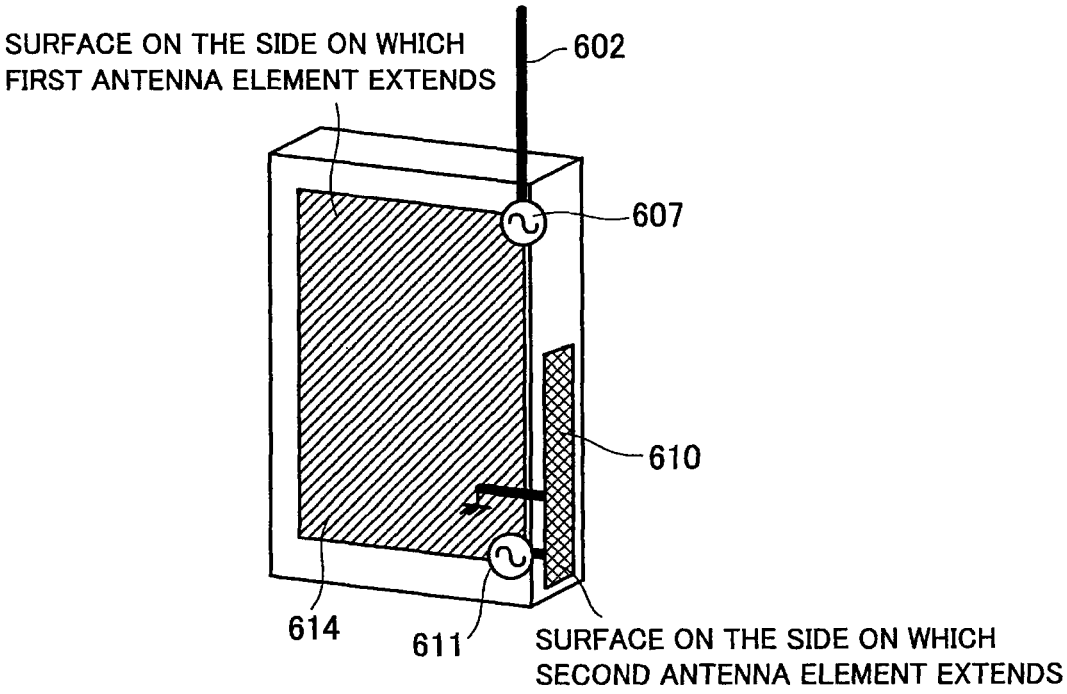

FIGS. 19(*a*) to 19(*c*) are diagrams each showing an outline construction of a mobile wireless unit according to the sixth embodiment of the present invention. FIG. 19(*a*) is a front view of the mobile wireless unit, and FIG. 19(*b*) is a partially perspective view of the back of the mobile wireless unit. The mobile wireless unit according to the sixth embodiment includes a first antenna element 602 having an electrical length of 0.12 wavelength of the first frequency band. The first antenna element 602 extends outside a case 601. As shown in FIG. 19(*a*), the mobile wireless unit includes, on the front surface of the case 601, a receiver 603 for outputting a sound from a calling terminal, a display section 604 for displaying characters such as a phone number, an input section 605 for inputting a phone number and a character, and a transmitter 606 for receiving a voice of a user.

As shown in FIG. 19(*b*), the mobile wireless unit includes, in the case 601, a first feeder 607 for feeding the first antenna element 602, a first matching circuit 608 for performing impedance matching to match impedance of the first antenna element 602 for the first frequency band, a first wireless communication circuit section 609 for outputting a signal to be transmitted by the first antenna element 602 and inputting a signal received by the first antenna element 602 through the first feeder 607 and the first matching circuit 608, a second antenna element 610 having an electrical length of 0.15 wavelength of the first frequency band, a second feeder 611 for feeding the second antenna element 610, a second matching circuit 612 for performing impedance matching to match impedance of the second antenna element 610 for the second frequency band, a second wireless communication circuit section 613 for outputting a signal to be transmitted by the second antenna element 610 and inputting a signal received by the second antenna element 610 through the second feeder 611 and the second matching circuit 612, and a board 614 having an electrical length of 0.27 wavelength of the first frequency band in a longitudinal direction of the board 614 and an electrical length of 0.12 wavelength of the first frequency band in a lateral direction of the board 614. The board 614 is provided with the first feeder 607, the first matching circuit 608, the first wireless communication circuit section 609, the second feeder 611, the second matching circuit 612, and the second wireless communication circuit section 613 and serves as a ground plate of the first antenna element 602 and the second antenna element 610.

The first antenna element 602 is a monopole antenna designed to extend from the first feeder 607, while the second antenna element 610 has the shape of inverted-F which is designed to extend from the second feeder 611. As shown in FIG. 19(*b*), the first and second feeders 607 and 611 are separated from each other in the longitudinal direction of the board 614, and the second antenna element 610 is positioned on the side opposite to the first antenna element 602 with respect to the longitudinal direction of the board 614, which is measured in the direction of the extension of the first antenna element 602. As shown in FIG. 19(*c*), the case 601 has a surface on the side on which the second antenna element 610 extends and a surface on the side on which the board 614 extends, the two surfaces of the case 601 being perpendicular to each other in the present embodiment. The present invention is not limited to the abovementioned construction. The two surfaces of the case 601 may not be perpendicular to each other. The electrical length between the first and second feeders 607 and 611 is equal to 0.27 wavelength of the first frequency band, which is the same as the electrical length of the board 614 in the longitudinal direction of the board 614.

Figure 20A:
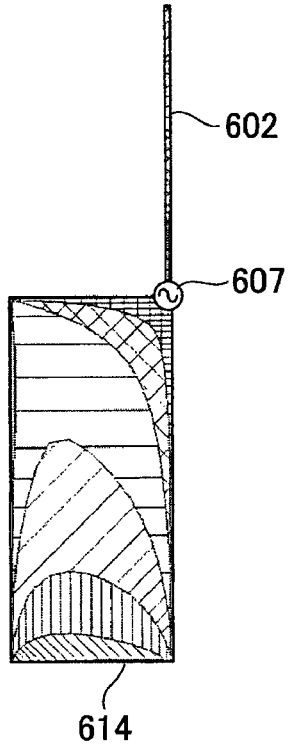
FIGS. 20(*a*) and 20(*b*) are diagrams each showing a distribution of a high frequency current in the first frequency band of the mobile wireless unit shown in FIGS. 19(*a*) and 19(*b*).
Figure 20B:
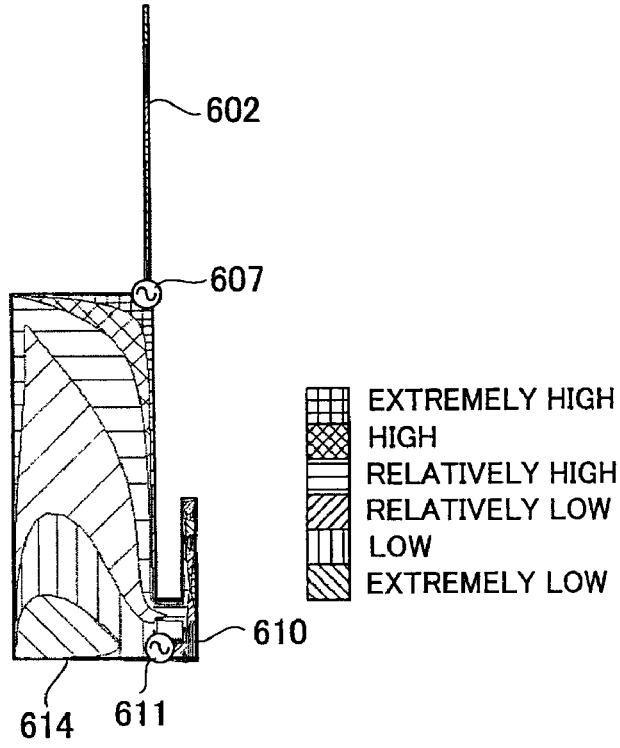

FIGS. 20(*a*) and 20(*b*) are diagrams each showing a distribution of a high frequency current. FIG. 20(*a*) shows the mobile wireless unit not having the second antenna element 610, and FIG. 20(*b*) shows the mobile wireless unit having the second antenna element 610. The second antenna element 610 is positioned on the side opposite to the first antenna element 602 with respect to the longitudinal direction of the board 614. As shown in FIG. 20(*b*), peak points of the high frequency current in the first frequency band are thus distributed to the vicinities of the first and second feeders 607 and 611.

The electrical length of the second antenna element 610 is determined based on the SAR corresponding to the first frequency band. The frequency band of the second antenna element 610 is thus not necessarily equal to a desired frequency band used for an application such as short-range wireless communications. The second antenna element 610 is therefore adjusted by the second matching circuit 112 to transmit and receive an electromagnetic wave in the desired frequency band.

Figure 21:
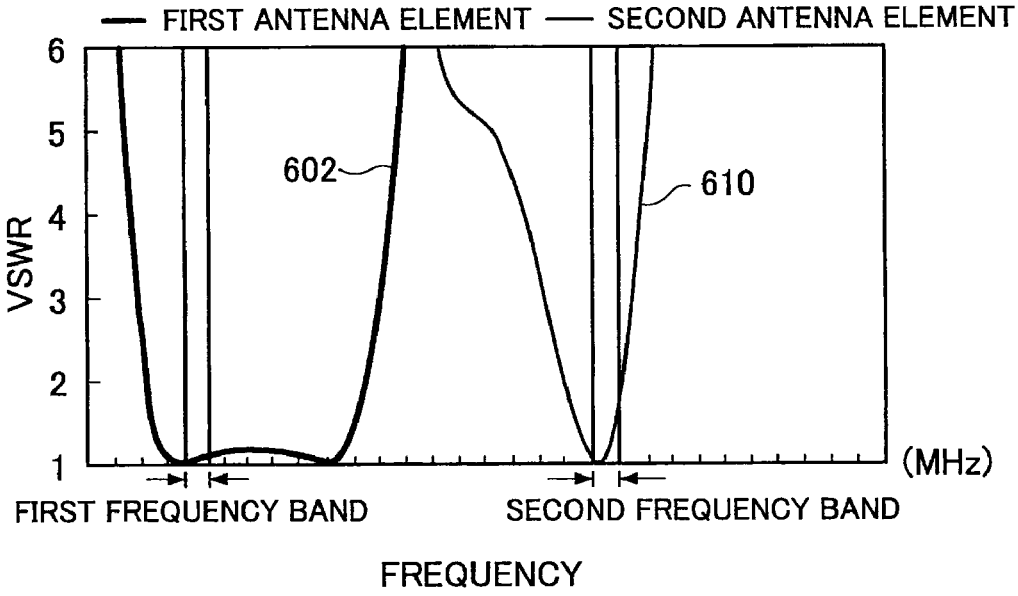
FIG. 21 is a graph showing the relationship between a frequency of an electromagnetic wave transmitted and received by a second antenna element shown in FIGS. 19(*b*) and 19(*c*) and a VSWR corresponding to the frequency under the condition that a second matching circuit shown in FIG. 19(*b*) is adjusted.
Figure 22:
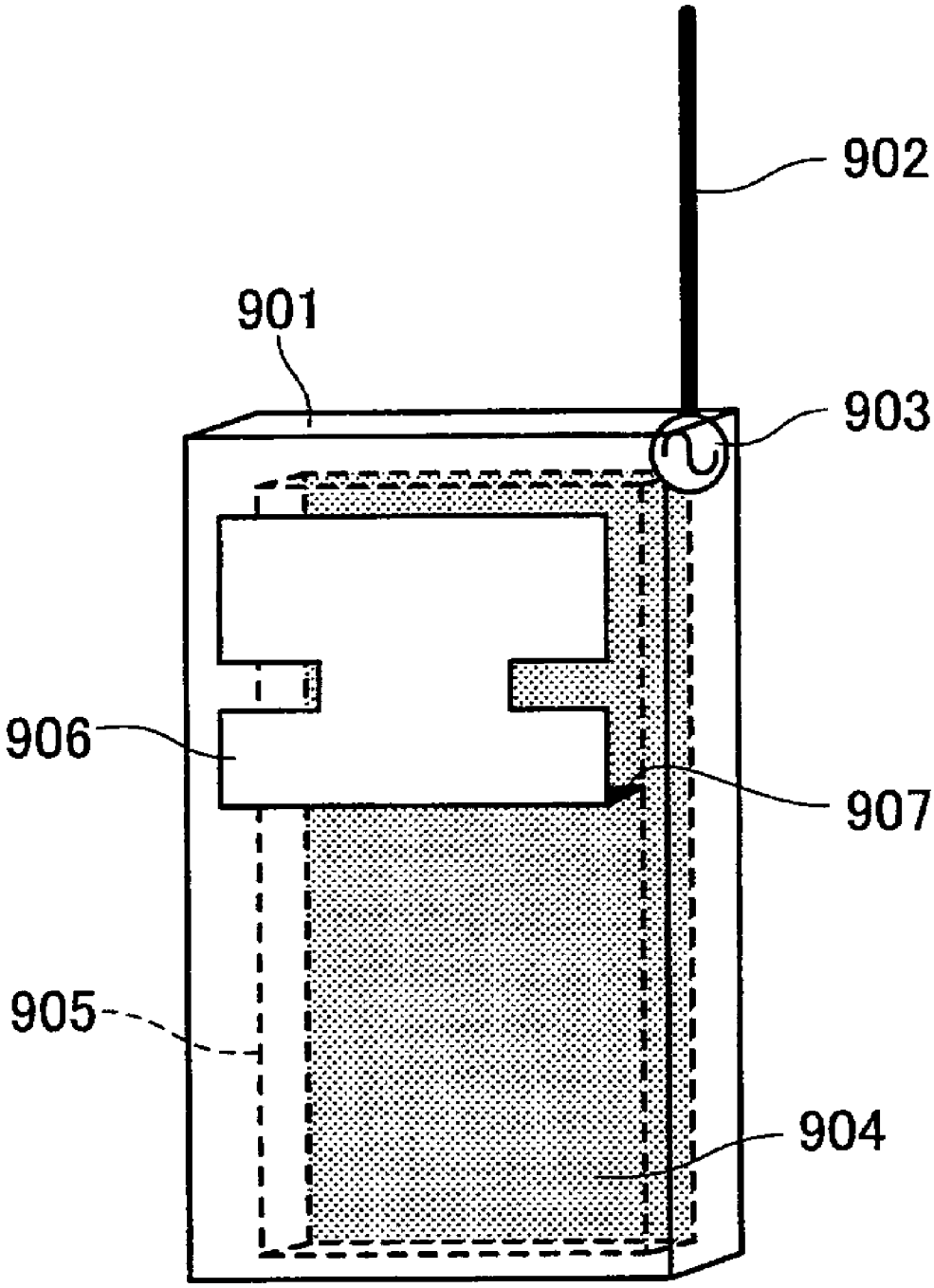
FIG. 22 is a diagram showing the construction of an antenna apparatus having a reduced SAR and mounted in a conventional mobile wireless unit.

In the antenna apparatus shown in FIGS. 10(*a*) and 10(*c*), the total of the electrical length of the first antenna element 602, the electrical length of the second antenna element 610, and the electrical length between the first and second feeders 607 and 611 is 0.63 wavelength of the first frequency band, which is larger than a half wavelength of the first frequency band and small than one wavelength of the first frequency band. In this case, the SAR corresponding to the first frequency band is reduced by 13%, and the second matching circuit 612 is adjusted to maintain the VSWR of the second antenna element within the range of 1 to 2.0 in the second frequency band as shown in FIG. 21.

The antenna apparatus thus constructed according to the sixth embodiment is constituted by the ground plate, the first antenna element for transmitting and receiving an electromagnetic wave in the first frequency band, the first feeder provided on the ground plate and feeding the first antenna element, the second antenna element for transmitting and receiving an electromagnetic wave in the second frequency band, and the second feeder provided separately from the first feeder on the ground plate and feeding the second antenna element, wherein the first antenna element is designed to extend from the first feeder to the outside of the ground plate, the second antenna element is designed to extend from the second feeder, and the total of the electrical length of the first antenna element, the electrical length of the second antenna element, and the electrical length between the first feeder and the second feeder is larger than a half wavelength of the first frequency band and is equal to or smaller than one wavelength of the first frequency band. The antenna apparatus thus constructed is capable of distributing peak points of the high frequency current, which flows in the mobile wireless unit such as the antenna elements and the ground plate and causes radiation of an electromagnetic wave from the antenna elements and the ground plate, to reduce the SAR without an additional component for reducing the SAR.

In the present embodiment, a linear monopole antenna is used as the first antenna element. The first antenna element may be replaced with an inverted-L antenna formed by folding a monopole antenna and having the same operating principle as the monopole antenna, a linear antenna using a ground plate, such as a helical antenna, or any one of the abovementioned antennas each of which transmits and receives an electromagnetic wave in each of frequency bands, to provide a similar effect to that of the second antenna element according to the sixth embodiment. In the first to fourth embodiments, a monopole antenna is used as the second antenna element. The second antenna element according to any one of the first to fourth embodiments, however, may be replaced with an inverted-L antenna as described in the fifth embodiment, a linear antenna using a ground plate such as a helical antenna, or an inverted-F antenna as described in the sixth embodiment, to provide a similar effect to that of the second antenna element according to the sixth embodiment.

The present invention is not limited to the straight type (bar-shaped) mobile wireless units according to the first to sixth embodiments, and may be applied to various types of mobile wireless units including a foldable mobile wireless unit without departing from the scope of the present invention. In the foldable mobile wireless unit having an antenna in the vicinity of a hinge of a lower case, a high frequency current can be distributed to reduce the SAR.

INDUSTRIAL APPLICABILITY

The antenna apparatus for a wireless unit and the mobile wireless unit according to the present invention are capable of reducing the SAR without an additional component for reducing the SAR, and useful for downsizing and reducing the distance between the front and back surfaces of the case of the mobile wireless unit.

What is claimed is:

1. An antenna apparatus for a wireless unit for transmitting and receiving an electromagnetic wave in each of frequency bands, comprising:

a ground plate;

a first antenna element for transmitting and receiving an electromagnetic wave in a first frequency band;

a first feeder, provided on said ground plate, for feeding said first antenna element;

a second antenna element for transmitting and receiving an electromagnetic wave in a second frequency band; and a second feeder, provided separately from said first feeder on said ground plate, for feeding said second antenna element, wherein said first antenna element is designed to extend from said first feeder to the outside of said ground plate, said second antenna element is designed to extend from said second feeder, and the total of an electrical length of said first antenna element, an electrical length of said second antenna element, and an electrical length between said first and second feeders is larger than a half wavelength of said first frequency band and equal to or smaller than one wavelength of said first frequency band.

2. An antenna apparatus for a wireless unit as set forth in claim 1, wherein said first and second antenna elements are in spaced relationship with each other, and the same in direction as each other.

3. An antenna apparatus for a wireless unit as set forth in claim 1, wherein said first and second antenna elements are substantially in parallel relationship to each other or are substantially in spaced relationship with each other.

4. An antenna apparatus for a wireless unit as set forth in claim 1, wherein said second antenna element extends from a point located in symmetrical relationship to a point from which said first antenna element extends with respect to the center of a diagonal line of said ground plate.

5. An antenna apparatus for a wireless unit as set forth in claim 4, wherein said first and second feeders are located in symmetrical relationship to each other with respect to the center of said diagonal line of said ground plate.

6. An antenna apparatus for a wireless unit as set forth in claim 1, wherein said first and second antenna elements are substantially in perpendicular relationship with each other.

7. An antenna apparatus for a wireless unit as set forth in claim 1, wherein said second antenna element has the shape of straight line.

8. An antenna apparatus for a wireless unit as set forth in claim 1, wherein said second antenna element has the shape of inverted-F.

9. An antenna apparatus for a wireless unit as set forth in any one of claims 1 to 8, further comprising a matching circuit for matching with said second antenna element in a desired frequency band.

10. An antenna apparatus for a wireless unit as set forth in claim 1, wherein said first feeder is provided at an end portion of said ground plate, and said second feeder is provided at another end portion of said ground plate.

11. A mobile wireless unit comprising said antenna apparatus for a wireless unit as set forth in claim 1.

* * * * *